US005261199A

United States Patent [19]

Schmidt

[11] Patent Number: 5,261,199

[45] Date of Patent: Nov. 16, 1993

[54] HIGH DENSITY FOAM BURIAL VAULT

[75] Inventor: Horst Schmidt, Windsor, Canada

[73] Assignee: Build-A-Mold Limited, Windsor, Canada

[21] Appl. No.: 809,701

[22] Filed: Dec. 17, 1991

[51] Int. Cl.[5] ..... E04H 13/00; B65D 1/22; A61G 17/00

[52] U.S. Cl. ..... 52/141; 52/128; 27/35; 220/4.24; 206/519

[58] Field of Search ..... 52/141, 135, 136, 139, 52/140, 142, 128; 27/11, 19, 35; 220/4.26, 4.27, , 4.24; 206/518, 519

[56] References Cited

U.S. PATENT DOCUMENTS

| | | | |
|---|---|---|---|
| 1,659,472 | 2/1928 | Rector et al. . | |
| 3,244,312 | 4/1966 | Lawson | 206/519 |
| 3,439,461 | 4/1969 | Chandler et al. . | |
| 3,464,171 | 9/1969 | Chandler et al. . | |
| 3,541,747 | 11/1970 | Olson et al. . | |
| 3,787,545 | 1/1974 | Chandler et al. . | |
| 3,839,768 | 10/1974 | McQuestion . | |
| 3,868,799 | 3/1975 | Hayward | 52/131 |
| 3,878,657 | 4/1975 | Ferver | 52/141 |
| 3,898,718 | 8/1975 | Eubank | 27/35 |
| 4,060,581 | 11/1977 | Darby et al. . | |
| 4,096,947 | 6/1978 | Morse | 206/519 |
| 4,253,220 | 3/1981 | Work | 27/35 |
| 4,372,018 | 2/1983 | Miller, IV et al. | 27/35 |
| 4,387,491 | 6/1983 | Schaaf et al. . | |
| 4,925,045 | 5/1990 | Logsdon | 220/4.24 |

FOREIGN PATENT DOCUMENTS

| | | | |
|---|---|---|---|
| 2487895 | 2/1982 | France . | |
| 2507658 | 12/1982 | France | 52/128 |
| 1158465 | 7/1969 | United Kingdom | 220/4.24 |

*Primary Examiner*—Carl D. Friedman
*Assistant Examiner*—Christopher T. Kent

[57] ABSTRACT

A high density closed-cell foam burial vault is disclosed. The vault consists of top and bottom halves which are formed of a closed-cell foam having a density between 8–30 pounds per cubic feet. The foam is sufficiently rigid to protect a casket within the burial vault, and is also resistant to leakage of water into the vault. The foam results in a lightweight, easy to manufacture burial vault. The top and bottom halves nest within each other, such that a large number of foam burial vaults may be stored in a relatively small space.

13 Claims, 1 Drawing Sheet

HIGH DENSITY FOAM BURIAL VAULT

BACKGROUND OF THE INVENTION

This invention relates to a burial vault which is formed of a high density closed-cell foam.

Burial vaults used to surround a casket in a grave have historically been formed of cement, such that they have sufficient rigidity to fully protect the casket. Cement burial vaults are heavy, and thus difficult to manufacture, store, and utilize. Further, the prior art cement burial vaults have allowed seepage of ground water into the vault such that it has access to the casket. The leakage waters may escape back outwardly of the burial vault. Should the corpse within the casket have a disease, that disease could potentially be carried with the water escaping the burial vault. For that reason, it would be desirable to have a leakage resistant burial vault.

Foam burial vaults have been proposed, however, they have typically been formed of low density open-cell foams which are not sufficiently rigid to adequately protect the casket. These burial vaults have typically included inner and outer layers of glass fiber resins to add additional rigidity. Due to the additional layers, these prior art vaults have been unduly expensive and complicated to manufacture. Further, ceneteries typically stock a large number of vaults, and the prior art vaults have required a relatively large amount of storage space.

SUMMARY OF THE INVENTION

In a disclosed embodiment, a foam burial vault is formed entirely of high density closed-cell foam. The foam is sufficiently rigid to protect the casket within the vault. Further, the high density closed-cell foam is leakage resistant, such that water does not leak into the vault. The foam preferably has a density of 8–30 pounds per cubic feet.

In another feature of the present invention, the burial vault is formed of substantially identical top and bottom halves that nest within each other. Thus, a number of burial vaults can be stacked in a relatively small space. Since the burial vaults are of relatively light weight due to their foam construction, they may be stored in relatively high stacks.

These and other features of the present invention can be best understood from the following specification and drawings, of which the following is a brief description.

DETAILED DESCRIPTION OF A PREFERRED EMBODIMENT

Figure 1:
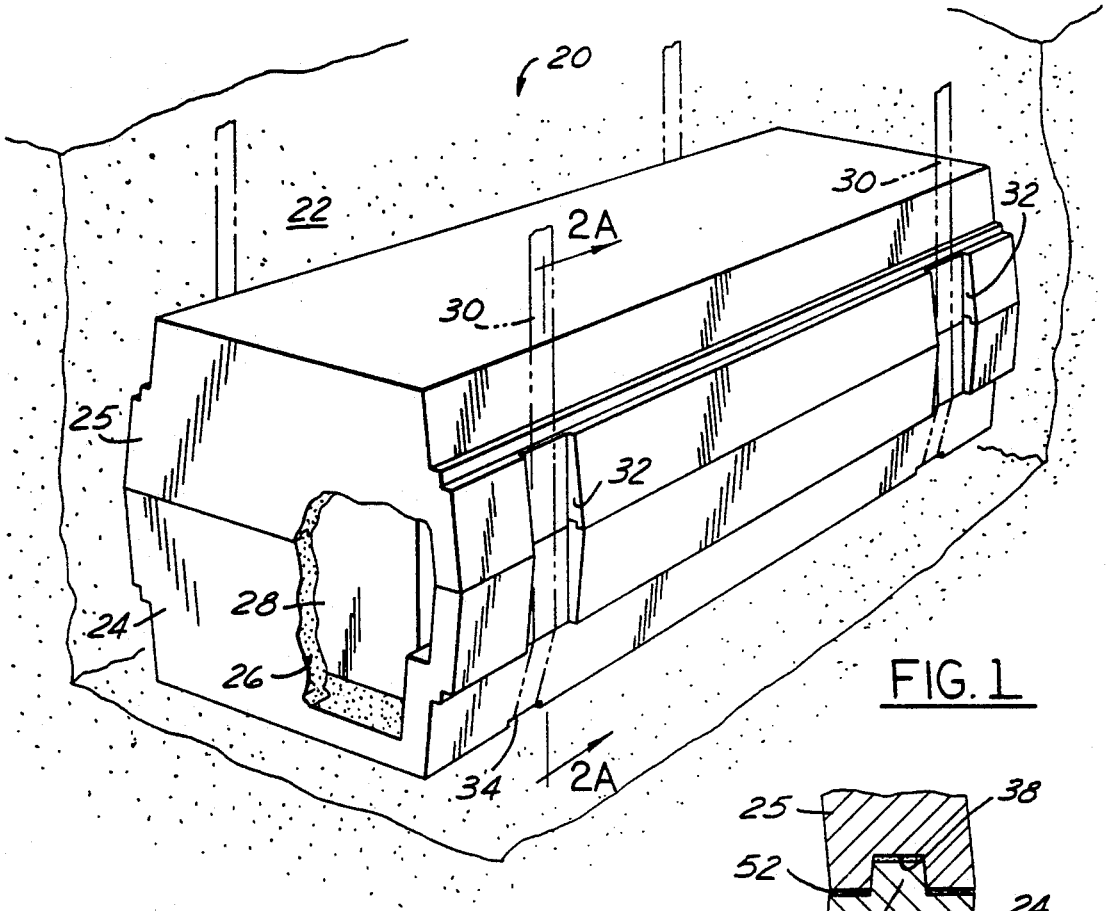
FIG. 1 is a perspective view of a foam burial vault according to the present invention.

A foam burial vault 20 is shown within a grave 22 in FIG. 1. Burial vault 20 has a bottom half 24 which mates with a top half 25 to form a vault enclosure. Both bottom half 24 and top half 25 include wall 26 formed of a closed-cell foam. A casket 28 is enclosed within a space defined between bottom half 24 and top half 25.

Straps 30 are placed in notches 32 on the lateral sides of burial vault 20, and notches 34 on the bottom of burial vault 20. Straps 30 are used to lower burial vault 20 into grave 22.

Figure 2B:
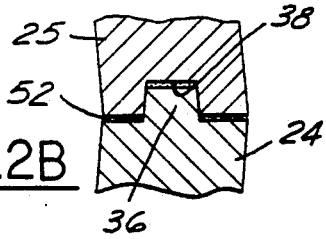
FIG. 2B is an enlarged view of the portion identified by the circle 2-B in FIG. 2.
Figure 2A:
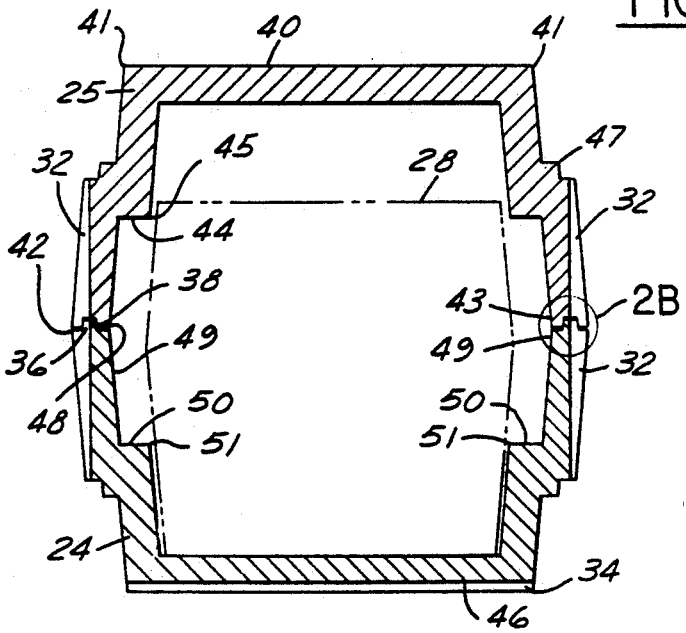
FIG. 2A is a cross-sectional view along line 2—2 as shown in FIG. 1.

FIG. 2A is a cross-sectional view along line 2—2 as shown in FIG. 1. Bottom half 24 includes a vertically upwardly extending tongue 36 received in a groove 38 in top half 25. This tongue and groove connection ensures a watertight seal between top half 25 and bottom half 24. Since tongue 36 is in bottom half 24, any leakage water must overcome gravity and climb over tongue 36 to leak into burial vault 20.

Top half 25 consists of a uppermost surface 40 having an outer lateral dimension of a first distance measured between ends 41. Top half 25 has a vertically lowermost surface 42 which includes notch 38. The distance between the spaced internal ends 43 of lowermost surface 42 is of a second distance. A ledge 44 extends laterally inwardly from each lateral inner wall of top half 25. The first distance between ends 41 is less than the second distance between the ends 43. Ledges 44 extends laterally inwardly to laterally innermost points 45. Points 45 are spaced by a third distance which is less than the first distance between ends 41.

Bottom half 24 includes a vertically lowermost surface 46 which has a lateral extent that is approximately equal to the first distance. The vertically uppermost surface 48 of bottom half 24 has internal ends 49 spaced by a distance which is approximately equal to the second distance. Ledges 50 extend laterally inwardly from each internal wall of bottom half 24 to laterally innermost points 51, with the opposed points 51 being spaced by a distance approximately equal to the third distance. Blocks 47 are formed at an outer surface of top half 25 and bottom half 24. The spacing between the various surfaces on top half 25 and bottom half 24 facilitates the nesting stacking of top halves 25 and bottom halves 24, as will be explained below. As shown in FIG. 1, the ledges extends around all four sides.

As shown in FIG. 2B, an adhesive 52 is placed on one of surface 42 or surface 48. Preferably, an adhesive which is actuated on contact, and which is selected to bind foam, is utilized.

Figure 3:
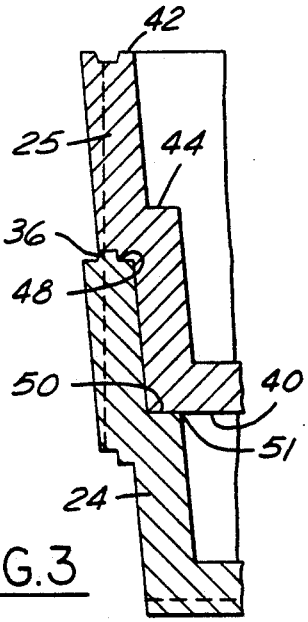
FIG. 3 is a cross-sectional view showing a further feature of the present invention.

As shown in FIG. 3, since ledge 50 has points 51 spaced by a distance less than the outer ends 41 of vertically uppermost surface 40, top half 25 may be stored within bottom half with vertically uppermost surface 40 may be supported on ledges 50. Vertically uppermost surface 40 moves vertically downwardly past ends 49, since ends 49 are spaced by a distance greater than the laterally outer dimension of vertically uppermost surface 40. Block 47 rests on surface 48 laterally inwardly of tongue 36.

A subsequent bottom half 24 may now be stacked within top half 25. Vertically lowermost end 46 will be supported upon ledge 44. Block 47 rests on surface 42. In this way, a large number of foam burial vaults 20 may be stacked within a relatively small space. Due to their light weight, they may be stacked to a relatively great vertical height, without being difficult to move.

In a most preferred embodiment of the present invention, the high density close-celled foam has a density of 8–30 pounds per cubic foot. A foam available under the trademark Dylark TM is preferably utilized. The burial vault 20 is preferably formed using known molding techniques for high density closed-cell foam. Most preferably, the burial vault is formed with an expanded bead injection molding process using steam as an expanding agent.

A preferred embodiment of the present invention has been disclosed, however, a worker of ordinary skill in the art will recognize that certain modifications would come within the scope of this invention. Thus, the following claims should be studied to determine the true scope and content of the present invention.

I claim:

1. A burial vault comprising:

a bottom half and a top half, said top and bottom halves having a generally longitudinal dimension and a shorter lateral dimension, said bottom and top halves being selectively secured together to provide a watertight seal, and define a space within said bottom and top halves sized and shaped for receipt of a casket;

both said top and bottom halves having an innermost and an outermost surface and being formed of a closed-cell foam, and said top and bottom halves being formed of said foam at an innermost and an outermost surface and between said innermost and outermost surfaces;

said top half having a closed vertically uppermost surface of a first laterally outer dimension, said bottom half having an open vertically uppermost surface with laterally spaced internal ends spaced by a second distance, said second distance being greater than said first dimension, and ledges extending laterally inwardly from each laterally spaced internal end of said bottom half, said ledges each extending to a laterally innermost end spaced from an opposed laterally innermost end by a third distance which is less than said first dimension, such that said top half may be stacked within said bottom half and said vertically uppermost surface of said top half will be supported on said ledges of said bottom half; and said top half having an open vertically lowermost portion with laterally spaced internal ends spaced by a distance which approximates said second distance, and said bottom half having a closed vertically lowermost surface with laterally outer ends spaced by a distance which approximates said first dimension, said top half having ledges extending laterally inwardly from each laterally spaced internal end of said top half, said ledges each extending to a laterally innermost end spaced from an opposed laterally innermost end by a fourth distance which is less than said first dimension, such that said bottom half may be stacked within said top half and said closed vertically lowermost surface of said bottom half will be supported on said ledges of said top half.

2. The burial vault as recited in claim 1, wherein said foam has a density of between 8–30 pounds per cubic foot.

3. The burial vault as recited in claim 1, wherein said bottom half has a tongue extending vertically upwardly and said top half has a groove for receiving said tongue.

4. The burial vault as recited in claim 1, wherein said top half having a groove formed in a laterally central portion of a wall which defines said open vertically lowermost surface, said bottom half having a tongue extending vertically upwardly from a wall which defines said open vertically uppermost surface, said tongue being spaced from a laterally inner end of said walls of said bottom half by a fourth distance, and said top half having a block surface with a laterally extending portion extending directly laterally outwardly from each outer lateral wall of said top half, and at a vertical position between said vertically uppermost surface and said vertically lowermost surface of said top half, said block extending to a generally vertically downwardly extending portion extending generally perpendicular to said laterally extending portion, and said vertically downwardly extending portions on said opposed walls of said top half being spaced by a distance which is less than or equal to said fourth distance, but greater than said second distance such that said block is supported on said vertically uppermost surface of said bottom half when a top half is stored within a bottom half.

5. The burial vault as recited in claim 4, wherein said bottom half having a block formed of similar portions and dimensions such that said bottom half block is supported on said vertically lowermost surface of said top half when a bottom half is stacked within said top half.

6. The burial vault as recited in claim 1, wherein said top and bottom halves having a generally long longitudinal direction, and a generally short lateral dimension, said ledges extending laterally inwardly from longitudinally extending walls, and said ledges extending over the entire longitudinal extent of said longitudinally extending walls.

7. The burial vault as recited in claim 1, wherein lateral walls of both said top and bottom halves having notches at longitudinally spaced discrete locations to receive belts to facilitate lowering of said foam burial vault.

8. The burial vault as recited in claim 1, wherein said top half having a groove formed in a laterally central portion of a wall which defines said open vertically lowermost surface, said bottom half having a tongue extending vertically upwardly from a wall which defines said open vertically uppermost surface, said tongue being spaced from a laterally inner end of said walls of said bottom half be a fourth distance, and said vertically downwardly extending portions on said opposed walls of said top half being spaced by a distance which is less than or equal to said fourth distance, but greater than said second distance.

9. A burial vault comprising:

a bottom half and a top half, said bottom and top halves being selectively secured together to provide a watertight seal and define a space within said bottom and top halves for receipt of a casket, said bottom and top halves being formed of foam; and said top and bottom halves having a generally long longitudinal direction and a generally short lateral dimension, said top half having a closed vertically uppermost surface extending laterally for a first laterally outer dimension, said bottom half having an open vertically uppermost surface having laterally spaced internal ends laterally spaced by a second distance, said second distance being greater than said first dimension, and ledges extending laterally inwardly from each laterally spaced internal end of said bottom half, said ledges each extending to a laterally innermost end spaced from an opposed laterally innermost end by a third distance which is less than said first dimension, such that said top half may be stacked within said bottom half, and said vertically uppermost surface of said top half will be supported on said ledge of said bottom half;

said top half having an open, vertically lowermost portion with laterally spaced internal ends spaced by a lateral distance which approximates said second distance, and said bottom half having a closed vertically lowermost surface having laterally outer ends spaced by a distance which approximates said dimension, said top half having ledges extending laterally inwardly from each laterally spaced internal end spaced from an opposed laterally innermost end by a lateral distance which is less than said first dimension, such that said bottom half may be stacked within said top half and said closed vertically lowermost surface of said bottom half will be supported on said ledges of said top half, said top half having a block surface having a laterally extending portion extending directly laterally outwardly from each outer lateral wall of said top half, and said block surface extending from said outer lateral wall at a vertical position between said vertically uppermost surface and said vertically lowermost surface of said top half, said block extending to a generally vertically downwardly extending portion extending generally perpendicular to said laterally extending portion, such that said block is supported on said vertically uppermost surface of said bottom half when a top half is stored within a bottom half.

10. The burial vault as recited in claim 9, wherein said bottom half having a block formed similar to said block of said top half such that said bottom half block is supported on said vertically lowermost surface of said top half when a bottom half is stacked within said top half.

11. The burial vault as recited in claim 9, wherein said top and bottom halves being formed of a closed-cell foam having a density of 8–30 pounds per cubic foot.

12. The burial vault as recited in claim 9, wherein said top and bottom halves having a generally long longitudinal direction, and a generally short lateral dimension, said ledges extending laterally inwardly from longitudinally extending walls, and said ledges extending over the entire longitudinal extent of said longitudinally extending walls.

13. The burial vault as recited in claim 9, wherein said top and bottom halves being formed of a closed-cell foam having a density of 8–30 pounds per cubic foot.

* * * * *